United States Patent [19]

Merrihew et al.

[11] 4,030,733

[45] June 21, 1977

[54] PORTABLE TENNIS COURT

[76] Inventors: Larry D. Merrihew, 23721 Maidstone Place; Phillip Zeck, 24321 Doble Ave., both of Harbor City, Calif. 90710

[22] Filed: May 28, 1976

[21] Appl. No.: 690,998

[52] U.S. Cl. ..... 273/29 BB; 52/298; 272/3

[51] Int. Cl.[2] ..... A63B 71/02

[58] Field of Search ..... 273/29 B, 29 BB, 29 BC, 273/95 H, 30; 272/3; 119/122, 123; 52/146, 149, 150, 152, 155, 298

[56] References Cited

UNITED STATES PATENTS

| | | | |
|---|---|---|---|
| 445,457 | 1/1891 | Stites | 52/298 |
| 991,913 | 5/1911 | Engelin | 52/150 |
| 1,641,246 | 9/1927 | Bassford | 273/29 BB |
| 2,159,633 | 5/1939 | Petersen | 273/29 BC |

FOREIGN PATENTS OR APPLICATIONS

| | | | |
|---|---|---|---|
| 16,342 | 10/1928 | Australia | 273/29 BB |
| 403,184 | 12/1933 | United Kingdom | 273/29 BB |
| 342,410 | 2/1931 | United Kingdom | 273/29 BB |

*Primary Examiner*—Richard C. Pinkham
*Assistant Examiner*—T. Brown
*Attorney, Agent, or Firm*—Edward A. Sokolski

[57] ABSTRACT

A tennis court structure including a playing net assembly and back net assemblies which are all readily collapsible and can be installed or disassembled in a relatively short period of time. Anchor pads for receiving the net support stanchions are permanently installed in the court surface at appropriate positions for the stanchions. These stanchions have angulated braces pivotally attached thereto which are withdrawn from a collapsed position colinear with the associated stanchion to an angulated bracing position where they are fitted together to inwardly brace the stanchion against the ground. Each stanchion is fitted within an associated pad member and latched thereto by means of a latch assembly, the net being attached at opposite ends thereof to the stanchions in a firmly supported position. Anchor pad members are also provided for removably retaining a plurality of poles used for supporting back and rear side netting for the back courts on either side of the net.

7 Claims, 9 Drawing Figures

12
13
14
15
16
17
17a
18
19
20
21
22
24
25
27
27b
27f
28
35
37
37a
39
40
40a
42
43
43b
44
45
47
48
49
50
52

PORTABLE TENNIS COURT

This invention relates to a portable tennis court, and more particularly to such a court which can readily be assembled and disassembled from collapsible portable components.

With the great interest in tennis that has arisen in recent years, tennis courts are much in demand. The cost of constructing courts, however, is quite high and requires the exclusive dedication of the land on which the court is installed to that single purpose. There are many situations, however, where the available real estate is limited so that it is impractical to exclusively devote the land to this one use.

The present invention solves this problem by enabling the dual use of the same area for both a tennis court and another purpose. Typically, for example, an existing concrete or blacktop parking lot or playground can be converted to a tennis court in a relatively short period of time and can then be changed back for use in its other function in a similar short time period. Further, the device of this invention enables the installation of a tennis court at a substantially lower cost than a permanent tennis court installation.

The device of the present invention comprises collapsible portable components that can be readily assembled and disassembled and transported to and from an installation site in an ordinary passenger car.

It is therefore an object of this invention to enable the dual use of a piece of land for both a tennis court and some other purpose.

It is a further object of this invention to provide a tennis court structure which can be installed at relatively low cost.

It is still another object of this invention to provide a portable tennis court structure which is easy to assemble and disassemble and transport to and from an installation site.

Other objects of the invention will become apparent as the description proceeds in connection with the accompanying drawings, of which:

Briefly described, the invention is as follows: A pair of collapsible stanchion-brace assemblies are provided for supporting the playing net. These assemblies comprise a pair of stanchions, each of which has a pair of brace bars pivotally supported thereon. An anchor pad is installed in the playing surface at an appropriate position for each of the stanchions. The stanchions are inserted in the anchor pads and latched thereto with the brace bars joined together to form a triangular configuration with the stanchion, the brace bars extending inwardly towards each other with one of such bars running along the playing surface. The net is supported between the stanchions with the brace bars bracing the stanchions against the net tension. Telescoping poles are provided for supporting back court netting at either end of the court, there being anchor plates installed in the playing surface for supporting each of such poles.

Figures 1, 7, 9:
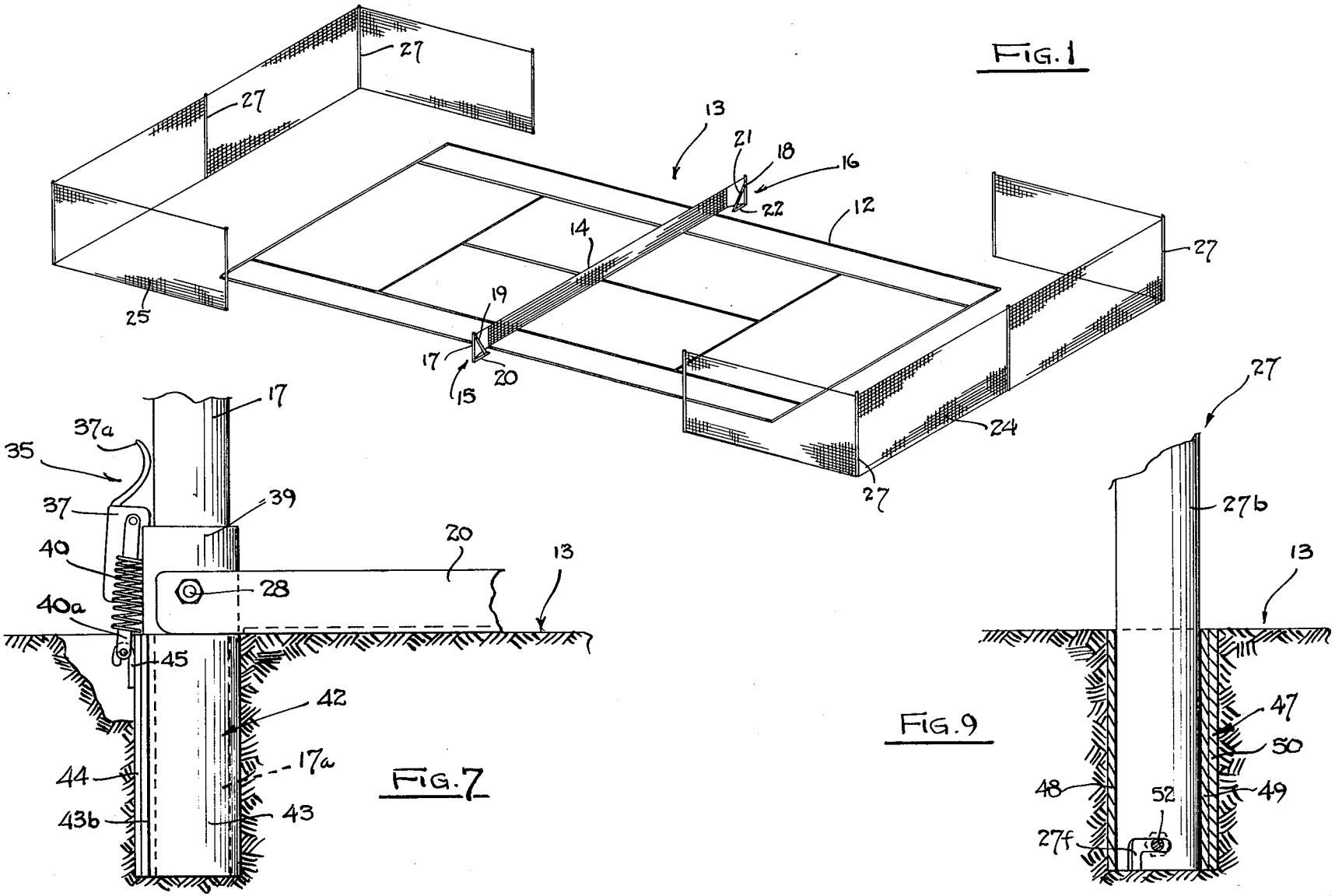
FIG. 1 is a perspective view illustrating the portable tennis court of the invention.
FIG. 7 is a side elevational view illustrating the preferred embodiment of the anchor pad assembly installed in the playing surface with the stanchion-brace assembly installed in such pad.
FIG. 9 is a side elevational view illustrating the installation of the support poles of FIG. 8 in an anchor pad installed in a playing surface.

Referring now to FIG. 1, the fully assembled tennis court of the invention is illustrated. The court lines 12 may be permanently painted or removably formed by tape on the playing surface 13 which may otherwise be used as a parking lot, school yard, playground, etc. The playing net 14 is supported between stanchion-brace assemblies 15 and 16 which are formed from stanchions 17 and 18 having brace bars 19, 20 and 21, 22, respectively, pivotally supported thereon and joined together with the stanchion to form a triangular configuration. Brace bars 20 and 22 run along the court surface 13 and thus brace the stanchions against inward tension of the net. The stanchions 17 and 18 are inserted in anchor pads as to be described further on in the specification, these anchor pads being permanently installed in playing surface 13.

Back court netting sections 24 and 25 are provided on either side of the court and are supported on collapsible poles 27. Poles 27 are removably installed in anchor pads 47 which are permanently installed in playing surface 13, as to be described further on in the specification.

Figure 3:
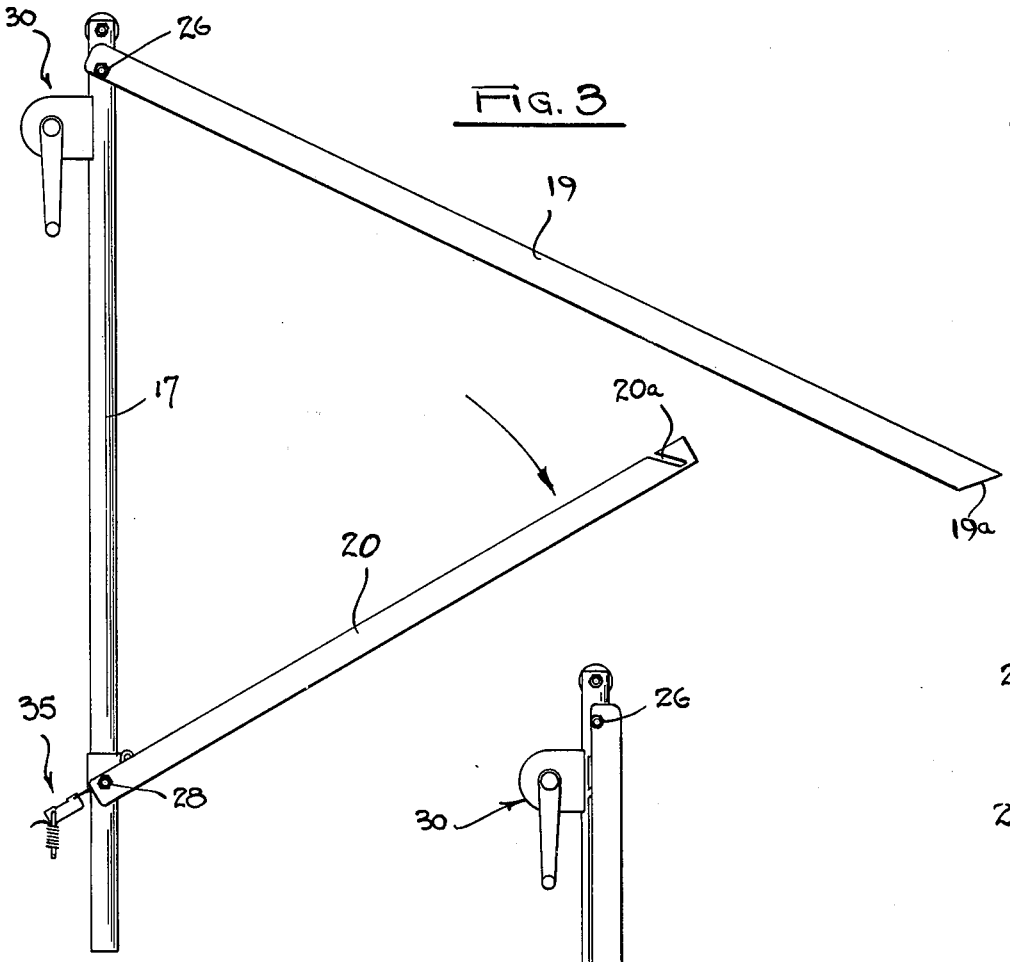
FIG. 3 is a side elevational view of the stanchion and brace structure of FIG. 2, shown partially assembled.
Figure 2:
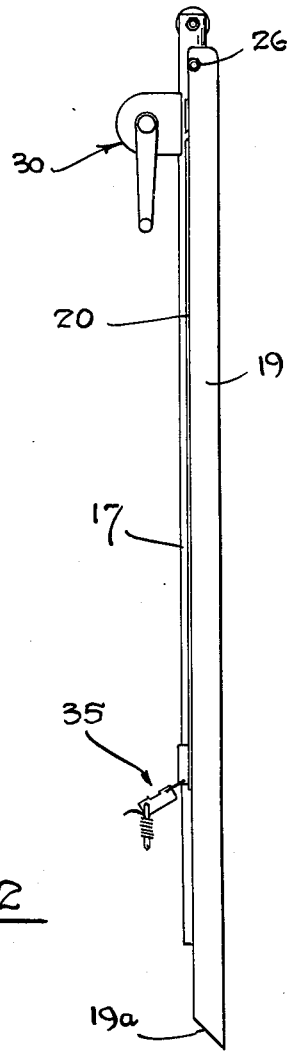
FIG. 2 is a side elevational view illustrating the stanchion and brace structure of a preferred embodiment of the invention in its collapsed folded condition.

Referring now to FIGS. 2–5, a preferred embodiment of the stanchion-brace assembly of the preferred embodiment of the invention is illustrated. This assembly is shown as fully collapsed in FIG. 2, in the process of being assembled in FIG. 3, and fully assembled (but not installed in the anchor pad) in FIGS. 4 and 5. As can be seen from the various FIGS. stanchion 17 has a first brace bar 19 pivotally attached thereto near the upper end thereof by means of bolt 26, and a second brace bar 20 pivotally attached thereto by means of bolt 28 at a position spaced from the bottom end of the stanchion. Brace members 19 and 20 are in the form of channel bars. The unit is assembled from the collapsed position shown in FIG. 2 by pulling brace members 19 and 20 out from stanchion 17 as shown in FIG. 3, and finally inserting the end portion **19*a* in slots 20*a* formed in the end of brace member 20. Stanchion 17 has a conventional net tensioning assembly 30 fixedly attached thereto, which includes a hand crank 31, a ratchet assembly 32 and a reel portion 33, on which the cable or cord supporting the top of the net is wound. Pivotally supporting just above bottom portion 19*a* of the stanchion is latching assembly 35. This assembly includes a latch plate 37 which is pivotally supported on collar 39, which in turn is fixedly attached to stanchion 19, and a spring 40 which is pivotally attached to latch plate 37.**

Figure 6:
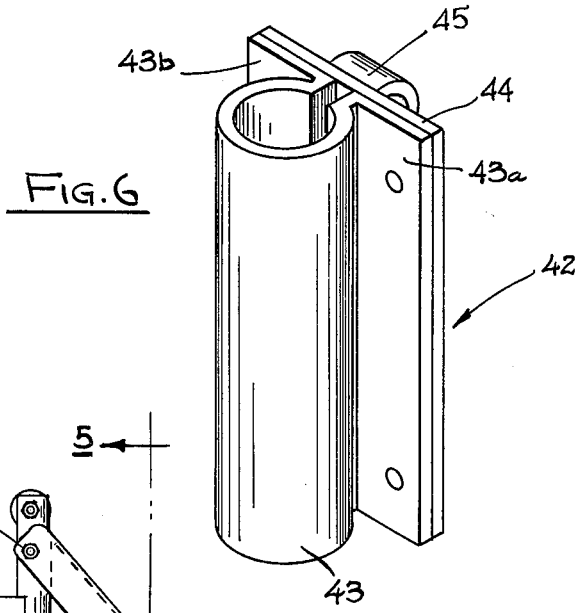
FIG. 6 is a perspective view illustrating a preferred embodiment of an anchor pad assembly which may be used for supporting the stanchion.
Figure 5:
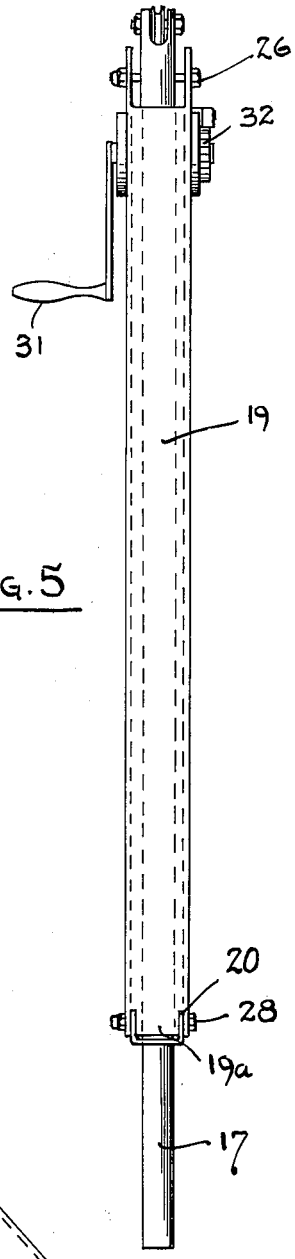
FIG. 5 is a view taken along the plane indicated by 5—5 in FIG. 4.
Figure 4:
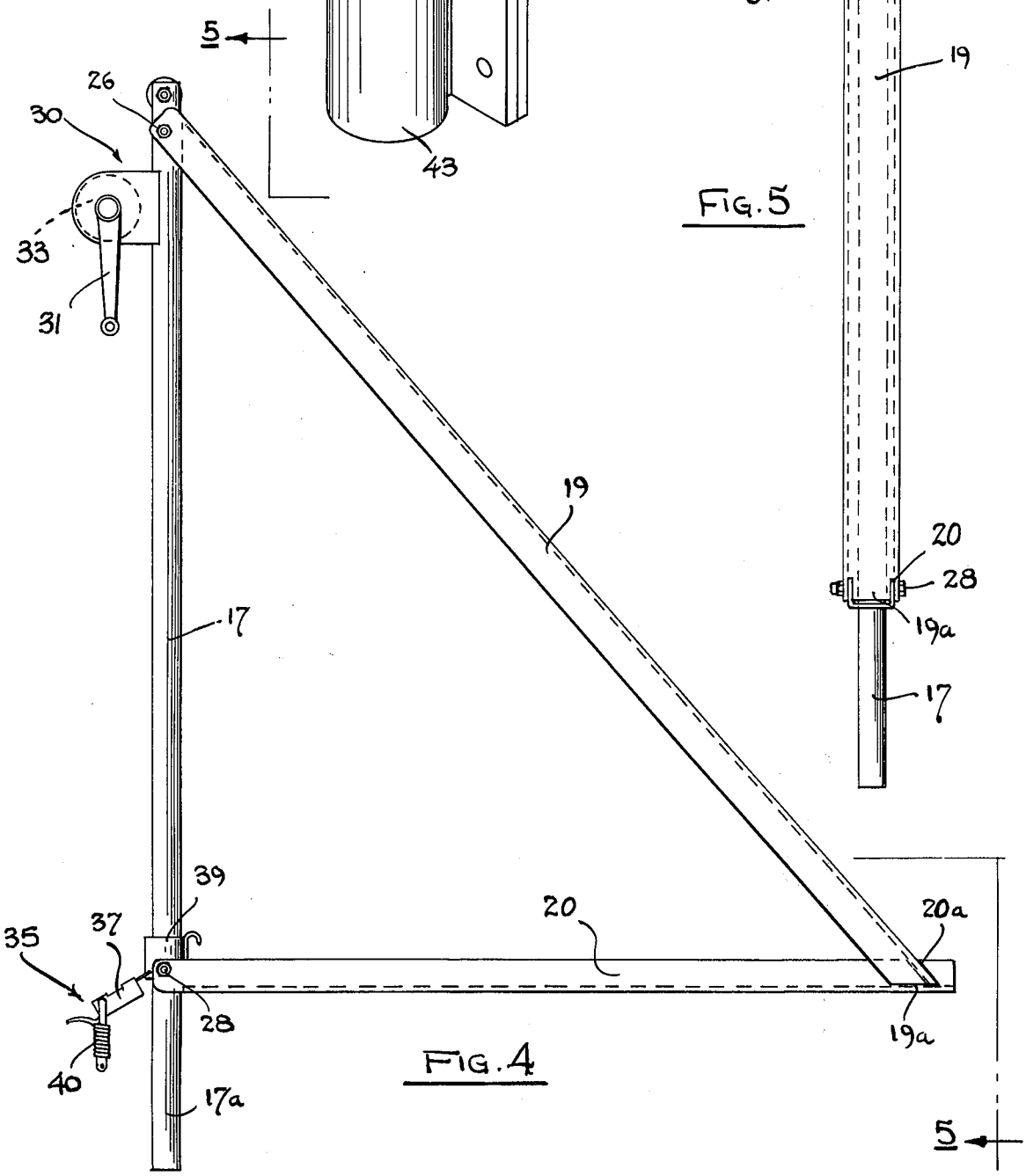
FIG. 4 is a side elevational view of the stanchion and brace structure of FIG. 2 shown in its fully assembled condition.

Anchor pad 42, as can best be seen in FIG. 6, is formed from a slitted tubular section 43 having a pair of flanges **43*a* and 43*b*** extending therefrom, with a flat plate 44 being riveted to the flanges. A catch member 45 is riveted to the flat plate 44 near the top end thereof.

Referring now to FIG. 7, anchor pad 42 is shown installed in the playing surface 13. This is accomplished by making an oversized hole in the surface to accommodate the pad and then setting the pad in the surface with its top end flush with the top of the surface by means of a suitable paving material, cement or the like. Catch member 45 is left exposed such that catch 40*a* of spring 40 can be engaged therewith when the end portion 17*a* of stanchion 17 is installed in the tubular portion 43 of the anchor pad. Stanchion 17 is latched to anchor pad 42 by manually positioning finger grip 37*a* against stanchion 17, thereby tensioning spring 40. With the stanchions installed in place, it can be seen that the brace members 20 and 22 rest against surface 13 and thus in conjunction with brace members 19 and 21 brace against the inward tension on the stanchions provided by the net.

Figure 8:
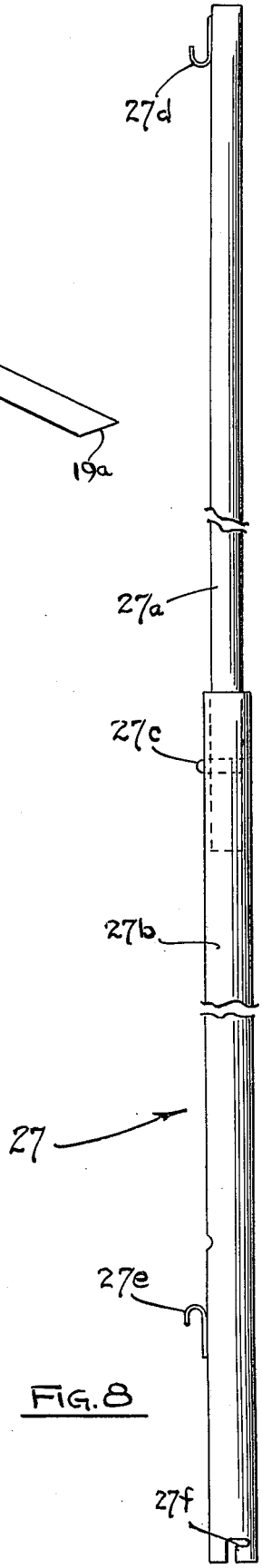
FIG. 8 is an elevational view illustrating a preferred embodiment of the support poles for use in supporting the back netting.

Referring now to FIGS. 8 and 9, a preferred embodiment of the support poles and anchor pads for supporting the back court netting are illustrated. The support poles 27 are formed from telescoping sections 27*a* and 27*b* which are locked in an extended position by means of pin member 27*c*. Hooks 27*d* and 27*e* are provided on the poles for supporting the netting. L-shaped grooves 27*f* are formed in the bottom portion of opposite walls of pole section 27*b* for use in anchoring each pole in its associated anchor pad 47 as shown in FIG. 9. Anchor pad 47 is generally similar in configuration to stanchion anchor pad 42 and has a tubular portion 48 with flanges 49 thereon which are fixedly attached to flat plate 50. Anchor pad 47, as for anchor pad 42, is set in the paving surface with suitable paving material, cement or the like. Anchor pad 47 has a bolt 52 extending between its opposite walls on which L-shaped grooves 27*f* of pole section 27*b* are hooked. The poles are thus firmly retained in their associated anchor pads and can be installed and removed in a relatively short period of time.

While the invention has been described and illustrated in detail, it is to be clearly understood that this is intended by way of illustration and example only and is not to be taken by way of limitation, the spirit and scope of this invention being limited only by the terms of the following claims.

We claim:

1. A tennis court structure for installation on a playing surface comprising:

a playing net, a pair of collapsible stanchion-brace assemblies for supporting said net therebetween, each of said assemblies including a stanchion, a first brace bar, one end of said bar being pivotally attached to said stanchion near one end thereof, a second brace bar, one end of said second bar being pivotally attached to said stanchion at a point therealong and spaced from said one end of said first brace bar attachment, the opposite ends of said bars being joined to each other to form a triangular configuration with said stanchion, and a latching assembly pivotally attached to said stanchion near the point of attachment of said second bar, and an anchor pad for supporting each of said stanchion-brace assemblies, said anchor pads being installed in said playing surface and each comprising a hollow member having a pair of flanges extending therefrom, a plate member attached to said flanges, and a catch member attached to said plate member and projecting therefrom, the other end of each of said stanchions being fitted in the hollow ends of an associated one of said pads with said stanchion latching assembly engaging the catch member of said plate member, the brace bars of one assembly extending towards the bars of the other assembly with said second bars running along the playing surface and braced thereagainst to support the stanchions against the inward pull of the net.

2. The tennis court structure of claim 1 wherein the brace bars are in the form of channel bars, said opposite ends of the second bars having slots formed therein into which said opposite ends of associated ones of the first bars are fitted.

3. The tennis court structure of claim 1 wherein each of said latching assemblies comprises a latch plate pivotally supported on its associated stanchion, a spring pivotally attached to the latch plate, a catch on said spring which engages the catch member of the anchor pad, and a finger grip extending from said latch plate, said spring being tensioned with the finger grip abutting against the stanchion.

4. The tennis court structure of claim 1 wherein the stanchions are tubular, the hollow sections of said anchor pads being in the form of slitted tubes which matingly receive said other ends of said stanchions.

5. The tennis court structure of claim 1 and additionally including a plurality of tubular telescoping poles, means for locking said poles in extended positions, an anchor pad for supporting each of said poles installed in said surface, means on each of said poles for engaging means on an associated one of said anchor pads for removably retaining the poles in the anchor pads, said poles being arranged around the back court portion of the tennis court, netting and means on said poles for supporting said netting around said back court portion.

6. The tennis court structure of claim 5 wherein the means on said poles for engaging said means on said anchor pads comprises L-shaped slots formed in the ends of opposite walls of said poles and said means on said pads for retaining the poles comprises bolts mounted in said pads and running transverse to the longitudinal axis of said pads, the slots hooking on said bolts.

7. The tennis court structure of claim 5 wherein the means on said poles for supporting the netting comprises a pair of oppositely facing hooks mounted near opposite ends of each of said poles.

* * * * *